United States Patent [19]

McEdwards

[11] Patent Number: 4,593,232

[45] Date of Patent: Jun. 3, 1986

[54] FLAME SIMULATING APPARATUS

[76] Inventor: Timothy K. McEdwards, 1040 W. MacArthur Blvd., #17, Santa Ana, Calif. 92707

[21] Appl. No.: 572,539

[22] Filed: Jan. 20, 1984

[51] Int. Cl.[4] ..... G05F 1/00; H05B 41/36; H05B 37/02; H05B 39/04

[52] U.S. Cl. ..... 315/199; 315/64; 315/294; 315/312; 315/313; 315/315; 323/243; 323/288

[58] Field of Search ..... 315/64, 291, 292, 294, 315/312, 313, 314, 315, 210, 217, 199; 323/242, 243, 288, 326

[56] References Cited

U.S. PATENT DOCUMENTS

| | | | |
|---|---|---|---|
| 1,863,500 | 6/1932 | Piersimoni | 315/64 |
| 3,074,008 | 1/1963 | McPhail et al. | 323/288 |
| 3,416,028 | 12/1968 | Levin | 315/64 X |
| 3,706,913 | 12/1972 | Malatchi | 315/292 |
| 4,064,414 | 12/1977 | Bergeson et al. | 315/200 R |
| 4,080,548 | 3/1978 | Johnson | 315/64 |
| 4,379,254 | 4/1983 | Hurban | 323/243 |
| 4,417,182 | 11/1983 | Weber | 315/313 |

*Primary Examiner*—Saxfield Chatmon
*Attorney, Agent, or Firm*—John G. Mesaros

[57] ABSTRACT

An apparatus for use with an electrical lamp to control the electrical energy from a source of electrical power to the lamp to simulate the emission of a flame, the apparatus including an intensity controller section having first and second manually adjustable signal generating devices, the first being settable to the desired average brightness of the lamp, and the second being settable to a desired "flicker intensity". The flicker is effected by means of circuitry effectively providing a modulation about the value of the first signal. The magnitude of "flickering" may be reduced to zero permitting un-modulated full range light dimming control. A phase-angle controllable switching device in circuit relation with the lamp is actuated by a gate circuit within the circuitry. One or more lamps may be employed. The apparatus is modular to accommodate the flame simulation effect on a plurality of lamps or a plurality of sets of lamps with single point master control over independently "flickering" lighting circuits. A novel multiple filament lamp for use in simulating the motion of flame has at least two filaments angularly disposed relative to each other within an envelope, with each filament independently energizable. An alternate embodiment of the lamp includes a third filament within a colored glass envelope with the two filaments being intermediate the colored glass envelope and the primary envelope.

33 Claims, 11 Drawing Figures

FLAME SIMULATING APPARATUS

BACKGROUND OF THE INVENTION

The background of the invention will be discussed in two parts:

1. Field of the Invention

This invention relates to flame simulating apparatus, and an incandescent lamp construction for use therewith, and more particularly to electronic apparatus for connection to one or more lamp devices for controlling the emissions thereof to simulate a candle light flame.

2. Description of the Prior Art

Flame simulating devices create a certain atmosphere which is warm and soothing. Attempts have been made to recreate the illusion in electrical lamp devices and apparatus. Such attempts have been directed to the dimming of conventional incandescent lamps, or the creation of special dedicated lamp bulbs which provide a "flickering" candle light effect.

One such dedicated lamp bulb is the gas-discharge type neon lamp, which is provided with two candle flame-shaped perforated electrodes encased within a neon gas-filled glass envelope. As the discharge occurs between the electrodes, the discharge path varies to simulate a candle light effect. In such a lamp device, the "flicker" effect is exaggerated, with the flicker intensity and brigthess being at a pre-set level determined by the characteristics of the electrode material and gas employed. In addition, the flicker parameters are poorly defined and not repeatable. With the use of neon, the color of the emitted light is not truly representative of the color of a flame, thus limiting the effectivity of the device as something akin to a candle light.

U.S. Pat. No. 3,790,998, shows and describes another dedicated lamp arrangement wherein the filament or light source is actually in motion. A long, flexible incandescent filament is looped about a centrally-located permanent magnet. AC-excited magnetic fields surrounding the energized filament set up a mechanical sympathetic resonance condition causing the filament to wildly swing back and forth past the central permanent magnet.

Other attempts at providing an atmosphere of dim or soothing light in an electrical lighting system have been directed at the "dimmer switches". Typically dimmer switches for incandescent lamps employ Triac controller devices for power control to the lamp controlled thereby. Generally, the main terminals of the Triac are connected in series with an AC circuit of one or more lighting branches. Triac gate triggering is commonly provided by an RC phase-shift network connected across the line, a capacitive charge storage element and a Diac to switch the charge into the Triac gate terminal once the required charge has accumulated.

The RC network time constant determines the phase angle where Diac break-off will occur, and this, in turn will switch the Triac "on" for some fractional portion of each complete half cycle of the alternating current source voltage. By selection of appropriate values, full-range light intensity control is possible using this approach. However, such circuits are simply attempts at controlling intensity, and do not have, as a purpose, the intent of simulating flame.

A more popular attempt at providing dimmed light is the conventional three-way light bulb. In such bulbs two unequal power independent filaments are enclosed inside one glass envelope to offer three different levels of total light output from one bulb dependnt on the combination of filaments energized, that is, one, the other ot both. Such lamps provide a low cost means for efficiently transitioning to one of three pre-set intensity, or brightness levels in accordance with lighting requirements, i.e., "reading" versus "general" lighting.

A more elaborate system exists at the Disneyland Park in California, a custom-fabricated system for providing flame simulation in street and interior lamps. Five relaxation oscillators utilizing neon lamps as their switching elements are adjusted to run at different frequencies from one another. The neon lamps are grouped in close proximity to a light-dependent resistor, such as a Cadmium Sulphide cell, which varies its resistance, or impedance, in accordance with the number and brightness of neon lamps firing at the same moment. The light-dependent resistor is effectively "looking" at several repetitively flashing light bulbs.

The light-dependent resistor is connected in series and shunt relation with other adjustable resistance elements to become a part of an RC phase-shift network similar to that described above. With such a system, the illumination and flicker is pre-set, with difficulty in modifying brightness and flicker intensity. The flicker characteristics are repetitive and not random as with a real flame, with extensive recalibration periodically required. In addition, due to the use of the light-dependent resistor, with its attendant characteristics modification on aging, flicker intensity is not well-defined, and unit-to-unit uniformity is difficult to obtain.

Accordingly, it is an object of the present invention to provide a new and improved flame simulating apparatus.

It is another object of the present invention to provide a new and improved electronic flame simulating apparatus for use with one or more lamp devices.

It is still another object of the present invention to provide a new and improved electronic flame simulating apparatus which provides for full-range dimming control as well as flicker intensity control.

It is yet another object of the present invention to provide a new and improved flame simulating apparatus which is voltage-controlled for stability and relative economy of construction.

It is a further object of the present invention to provide a new and improved flame simulating apparatus which is modular in construction, and may be used for one incandescent lamp, or for a set of such lamps, the apparatus having the capability of functioning as a conventional dimmer system.

It is still another object of the present invention to provide a new and inproved lamp device for simulating a moving candle flame.

It is a still further object of the present invention to provide a new and improved multiple filament lamp device for use in the flame simulating apparatus to simulate a moving candle flame.

SUMMARY OF THE INVENTION

The foregoing and other objects of the invention are accomplished by providing a new and improved electronic apparatus connectable to one or more incandescent lamps for providing full-range dimming or intensity control with modulation control about the level of intensity selected. The line voltage is rectified and a first variable DC voltage source is generated via a first potentiometer connected across this to provide a first control voltage for light intensity. A second potentiometer taps this control voltage for generating a second variable DC voltage source for providing the signal for flicker modulation control about this first control voltage, to provide a modulation signal to a comparator. The line voltage is monitored for "zero crossing" to synchronize the operation of a ramp generator, the output of which provides a second input to the comparator for actuation of a controllable semiconductor device, such as a Triac, to control the phase angle gating or "on" time, which in turn controls the energy provided to a lamp device. The flicker-intensity modulation is effected in a random manner by means of an asymmetrical pulse generator sourcing a peak sample and decay circuit, which provides gating signals to a squaring flip-flop, the output of which is essentially a pulse-width modulated signal, which is then suitable filtered through a low pass filter to provide a "flickering" input to the primary comparator to simulate a candle light effect at the lamp device.

The electronic apparatus may be modularly constructed to provide a master module with one or more slave modules to control one or more lamp devices, each with its own randomly modulated flickering effect.

A multiple filament incandescent lamp device has at least two filaments supported within a glass envelope, the filaments being angularly disposed relative to one another, having candle-shaped configurations with terminal connections independently energizable for simulating the motion of a candle flame. Each filament may be actuated by a separate module for this purpose.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
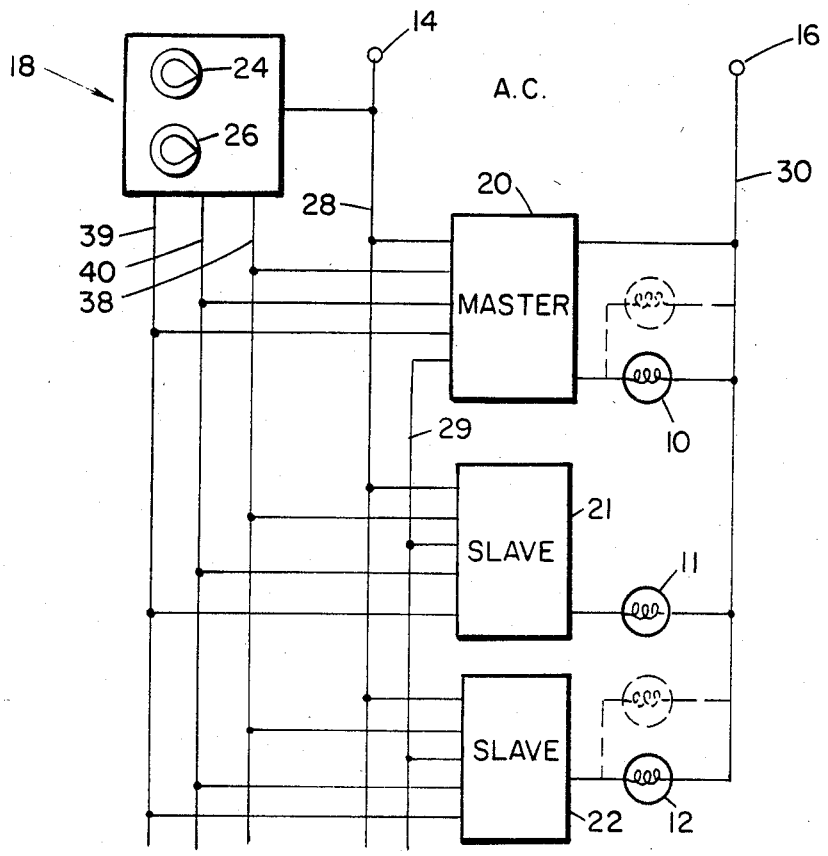
FIG. 1 is a block diagram of the flame simulation apparatus according to the invention.

Referring now to the drawings, and particularly to FIG. 1 there is diagrammatically illustrated a flame simulation apparatus which controls a plurality of lamp devices 10–12 from a source of alternating current voltage depicted by terminals 14 and 16, through an intensity controller 18, a "master" control module 20 and a plurality of "slave" modules 21–22, inclusive. The master module 20 (and each slave module 21, 22) includes means for voltage rectification and the intensity controller 18 includes first and second control knobs 24 and 26 which are rotated to effect changes in intensity (i.e., "dimming") and modulation (i.e., "flickering"), respectively.

The alternating current from terminals 14 and 16 is provided to the intensity controller 18, the master module 20 and the slave modules 21 and 22 over two leads, 28 and 30, with lead 28 connected to the inputs of each of the modules 20–22, with lead 30 serving as a common return for each of the lamp devices 10–12, the other ends of lamp devices 10–12 being connected to the output leads of the respective modules 20–22. The intensity controller 18 has one lead connected to the lead 28 with three output leads 38, 39 and 40 providing inputs to each of the modules 20–22, respectively. A lead 29 from the master module 20 is provided as an input to the slave modules 21 and 22 for providing a common "reset" signal as will be hereafter described.

Figure 2:
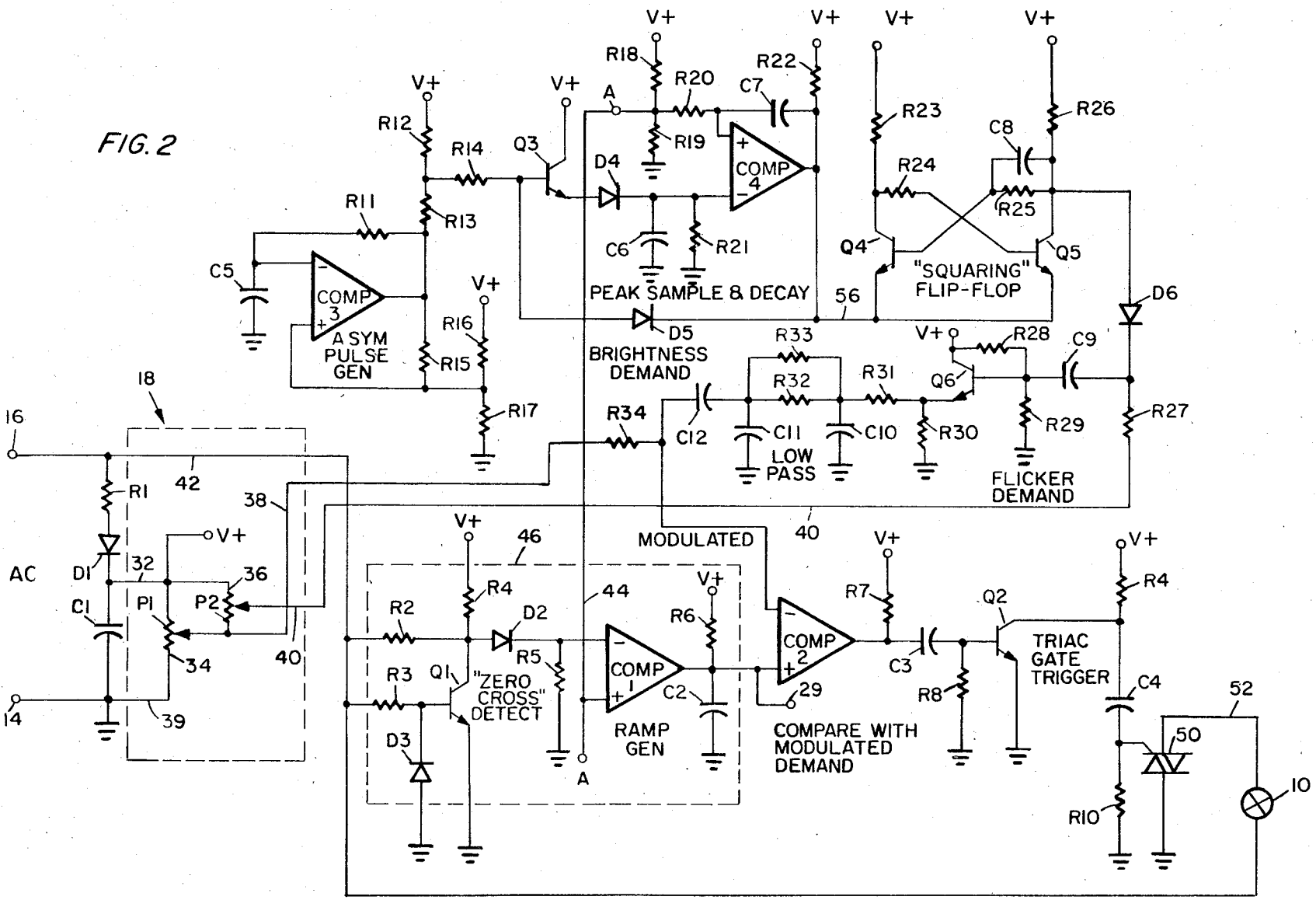
FIG. 2 is a detailed schematic of the flame simulation apparatus of FIG. 1.

Referring now to FIG. 2, the circuitry will now be described. Briefly, the circuitry to be described includes the following sub-circuits: a rectifier; an intensity control section; "zero-cross" detector; a ramp generator; an asymmetrical pulse generator; a peak sample and decay circuit; a squaring flip-flop; a low-pass filter; an intensity/modulation demand comparator circuit; and a controllable semiconductor circuit.

In the description, elements will be referred to in conventional schematic terms, that is a capacitor will be designated with the prefix "C" followed by a number; a resistor will be designated by the prefix "R" followed by a number; diodes will be designated by the prefix "D" followed by a number; potentiometers will be designated by the letter "P" followed by a number; transistors will be designated by the prefix "Q" followed by a number; and the comparators will be designated by the abbreviation "COMP" followed by a number, with the inverting and non-inverting inputs thereof being designated with a "−" and "+", respectively.

Circuit Description

In FIG. 2, the alternating current input is designated by terminals 14 and 16 with resistor R1, diode D1 and capacitor C1 connected in series between the terminals. The interconnection between the diode D1 and the capacitor C1 provides the source of the bias voltage V+ for the circuit at lead 32. Connected between lead 32 and terminal 16 is a potentiometer P1 with a second potentiometer P2 connected between the center tap of potentiometer P1 and lead 32. The voltage levels appearing at the center taps of potentiometers P1 and P2 are transmitted over leads 38 and 40, respectively, with lead 39 providing the ground connection. The potentiometers P1 and P2 are referred to as the intensity control section 18. A third lead 42 is connected directly to terminal 14, these three leads thus providing the necessary control signals to the balance of the circuit. Lead 42 corresponds to lead 30 in FIG. 1 and is also connected to the lamp device 10 to provide a current return path. Lead 38 provides a voltage indicative of the desired intensity of illumination (that is, the "brightness demand"), lead 40 provides a voltage within the intensity voltage as a control of the flicker (that is, the "flicker demand"), and lead 42 is monitored, as will be described to provide an indication of the state of the phase angle of the alternating current cycle.

With lead 42 being coupled through resistor R3 to the base of transistor Q1, the transistor Q1 and the components associated therewith form the "zero-cross" detector, the primary function of which is to detect the time during which the alternating current cycle goes through zero. A resistor R2 interconnects lead 42 and the collector of the transistor Q1, with a resistor R4 connected between the collector and the rectified voltage V+. The emitter is connected to ground with a diode D3 connected between the base and emitter of transistor Q1. The collector is coupled via diode D2 to the inverting input of a comparator COMP1, which is part of the ramp generator circuit. The inverting input is also connected to resistor R5, the other end of which is coupled to ground.

The non-inverting input of comparator COMP1 is connected to lead 44, which as will be hereinafter described, provides a reference voltage. The output of comparator COMP1 is connected both to a capacitor C2 to ground, and resistor R6 to the positive source of voltage V+.

As illustrated in FIG. 2, the "zero-cross" detector and ramp generator are depicted in a dotted line block 46. Within the modularity aspect of the present invention, the intensity control section 18 (also shown in dotted lines) is a separate module which may conveniently fit within a standard household switch receptacle. The balance of the circuit shown in FIG. 2 (including the rectifier) is included within the master module 20 shown in FIG. 1. For each slave module 21, 22, the circuitry is as shown in FIG. 2, with the exception of the two portions shown in dotted lines, that is, the intensity control section 18 and the "zero-cross" detector and ramp generator in block 46.

The output of the comparator COMP1 provides a first input to the non-inverting input of a second comparator COMP2, while also providing a reference or reset signal as will be hereinafter described, this signal being provided over lead 29. The output of comparator COMP2 is connected to the positive source of voltage V+ through resistor R7, and through a capacitor C3 to the base of transistor Q2, the emitter of which is coupled to ground, with a resistor R8 connected between the base and emitter thereof. The collector of transistor Q2 is connected to resistor R9 to the voltage source V+, and also the one end of capacitor C4 the other end of which is connected to the gate electrode of the controllable semiconductor device, or Triac 50. A resistor R10 is connected between ground and the gate electrode of Triac 50. Of the other two electrodes of the Triac 50, one is connected to ground, and the other is connected over lead 52 to the other end of lamp device 10. The comparator COMP2 is basically the intensity/-modulation demand comparator circuit previously refferred to, while the transistor Q2 and Triac 50, along with the associated components from the controllable semiconductor circuit.

The flicker modulation portion of the circuit will now be described. A comparator COMP3 has the non-inverting input thereof connected to the mid-point of a voltage divider formed with resistors R16 and R17, the other end of R17 being connected to ground, with the other end of R16 being connected to the positive voltage source V+. The mid-point is also coupled to the output of comparator COMP3 through a resistor R15. The inverting input is connected to a capacitor C5, the other end of which is coupled to ground. A resistor R11 connects the non-inverting input and output of comparator COMP3, with this output being connected to one end of a resistor R13, the other end of which is connected in series with a resistor R12 to the source voltage V+. This comparator COMP3 with its associated components is the asymmetrical pulse generator circuit, the output of which is transmitted through a resistor R14 connected at the interconnection of resistor R12 and R13, the other end of resistor R14 being coupled to the base of transistor Q3.

Transistor Q3 has the collector thereof connected to the voltage source V+, with the emitter coupled through a diode D4 to the inverting input of a comparator COMP4. A parallel RC circuit including capacitor C6 and resistor R21 interconnects this input to ground. A reference voltage is derived from a voltage divider consisting of resistors R18 and R19, which are connected in series between the voltage source V+ and ground, with the midpoint thereof being connected to lead 44 to provide the reference voltage to the comparator COMP1 of the ramp generator circuit. Simultaneously, this reference voltage is coupled through resistor R20 to the non-inverting input of comparator COMP4, which has this input and the output connected through capacitor C7.

The base of transistor Q3 is coupled to the anode of diode D5, the cathode of which is connected to lead 56. The output of comparator COMP4 is connected to lead 56, and through resistor R22 to the positive voltage source V+. The transistor Q3 and the comparator COMP4, along with the associated components form the peak sample and decay circuit.

The squaring flip-flop is formed from transistors Q4 and Q5, both having the emitters thereof coupled to lead 56, with the collectors connected through resistors R23 and R26, respectively, to the voltage source V+. The bases are cross-coupled to the collectors with resistor R24 interconnecting the collector of transistor Q4 with the base of transistor Q5. The base of transistor Q4 is connected through a parallel RC circuit including resistor R26 and capaacitor C8 to the collector of transistor Q5.

The collector of transistor Q5 is coupled to the anode of a diode D6, the cathode of which is connected, first to one end of resistor R27, and second to one end of capacitor C9, the other end of which is connected to the base of transistor Q6. The other end of resistor R27 is coupled to lead 40, which carries the control signal from the center tap of potentiometer P2.

Transistor Q6 has the base thereof connected to ground through resistor R29, and to its collector through resistor R28, the collector also being connected to the voltage source V+. The emitter of transistor Q6 is connected to ground via resistor R30 and to one end of resistor R31, the other end of which provides the input to a low-pass filter section.

The low-pass filter section includes parallel resistors R32 and R33, connected in series with the other end of resistor R31, with capacitor C10 being connected to this end of resistor R31, with the other end connected to ground. A second capacitor C11 is connected between ground and the other end of the parallel resistors R32 and R33, with a capacitor C12 connected between this junction and the inverting input of comparator COMP2. Lead 38 is likewise connected to this inverting input through resistor R34, lead 38 essentially carrying the control signal indicative of intensity as dictated by the position of the center tap of potentiometer P1.

The capacitors C9 and C12 serve as blocking capacitors, with the variable DC voltage source signals from P1 and P2 appearing at resistors R34 and R27, respectively, to provide signals indicative of the brightness demand and flicker demand, respectively.

Operation of the Circuit

The circuit of FIG. 2 will now be described with respect to the operation thereof. As will become apparent, the use of external control signals provide the primary advantage of single point master control (with "tracking") of multiple independently acting flame simulator modules, while enabling the use of low cost components with virtually no calibration requirements. In addition, the system will function as a conventional electric light dimming system with potentiometer P2 having the center tap thereof adjusted toward lead 38 thus providing the same voltage at resistors R34 and R27, and the only control signal thus available is that from potentiometer P1.

The power supply is a rudimentary unregulated supply composed of the resistor R1, the diode D1 and the capacitor C1 connected across the alternating current supply. During operation, the effective load impedance of the regulated voltage source V+ averages about a relatively constant value with resistor R1 at approximately 10,000 ohms. The potentiometers P1 and P2 each have a value of 50,000 ohms or less, and with the circuit shown will function well for five or six slave modules 21–22. The adjustment of potentiometer P1 adjusts the primary voltage form zero volts to a voltage equivalent to V+, while the adjustment of potentiomenter P2 adjusts the voltage on lead 40 from the selected voltage to zero volts. Thus there is a control voltage for intensity or system "brightness demand" appearing on lead 38, and a control voltage for "flicker demand" appearing on lead 40 for selecting "flicker" control. As will be described hereafter, the "flicker" intensity maintains a proportional relation to the selected intensity as a result of the dependency.

The output of the ramp generator, including comparator COMP1 provides a signal to the non-inverting input of comparator COMP2, which varies between ground and some maximum voltage determined by the value of the components. The non-inverting input of comparator COMP1 is tied to a reference voltage via lead 44. For the duration of the time that the zero-cross detector output is "high", the output of comparator COMP1 will pull to ground. When the output of the zero-cross detector is "low", the output of comparator COMP1 floats and capacitor C2 begins charging via resistor R6. An RC ramp curve is thus generated and applied to the non-inverting input of the comparator COMP2.

The zero-cross circuitry acts to "reset" the reference ramp ganerator at the beginning of each half-cycle of alternating current voltage during the time the input line voltage is at or near zero. This provides a minimum of 50 to 60 microseconds needed to insure complete reset of the reference ramp generator, this "reset" condition being sensed at lead 29. When the line voltage is at or nearly zero, transistor Q1 is rendered non-conducitve and the voltage divider of resistors R2 and R4 provides a "high" through diode D2 and resistor R5 to the inverting input of comparator COMP1. As the line voltage moves positive from zero, current via resistor R3 causes transistor Q1 to being conduction, thus allowing the start of the ramp. As the line voltage moves negative from zero, the collector of transistor Q1 moves in a negative direction via resistor R2, again allowing the start of a ramp. Transistor Q1 will begin passing collector-base current via diode D3 as limited by the value of resistor R2. The diode D2 is connected as a blocking diode to block negative excursions form the input of comparator COMP1. Thus a varying ramp voltage is applied as a first input to the intensity/modulation demand comparator circuit.

This reference ramp voltage is an analog voltage which varies as a function of time since "reset", thus providing a time-referenced ramp voltage generation. Essentially this is a regularly configured waveform. This voltage is then compared with a direct current voltage appearing at resistor R34, which is coupled to the inverting input of comparator COMP2, which provides an output state change of comparator COMP2 at the moment of equality of inputs. The time at which state change occurs will dictate the time into the half-cycle when the Triac 50 will be triggered "on". The voltage appearing at resistor R34 is dictated, in turn, by the setting of the potentiomenter P2, and sensed over lead 40 connected between the center tap thereof and resistor R34. The output state change of the comparator COMP2 is differentiated via capacitor C3 and resistor R8 to force momentary conduction of transistor Q2. The discharge of capacitor C4 is via the Triac gate terminal and generates enough surge current to initiate the conduction of the Triac 50. The capacitor C4 may recharge via resistor R9 for a full seven milliseconds.

According to the invention, means are provided for generating a pseudo-random flicker intensity characteristic. This is done by basic circuits, which when combined generate an exceptionally complex function. The basic concept of operation is that one circuit will periodically sample a variable voltage, and the time at which the next sample will be taken will be dictated by the amplitude of the last sample. Furthermore, the frequency of the voltage source is much higher than the maxiumum sampling rate, and is momentarily increased at the time of sampling. Further, still, the length of sampling time will vary with sample amplitude. These basic circuits are the peak sample and decay circuit, the asymmetrical pulse generator which sources the circuit, and a squaring flip-flop, which is in turn driven by the sampling circuit.

The comparator COMP3, in conjunction with its associated components is configured as a common Schmitt-type astable multivibrator, with suggested operating conditions at a rate of approximately 700 Hz, with an "on" duty cycle of approximately 35%. The voltage divider of resistors R12 and R13 creates a condition between V+ and a minimum voltage at their juncture dependng on the output state of comparator COMP3 at the moment.

Peak sample and decay to a reference voltage Vref is accomplished with respect to a reference voltage at the junction of resistors R18 and R19, this reference voltage being applied to the non-inverting input of comparator COMP4. When the inverting input of comparator COMP4 is above the reference voltage, the output of comparator COMP4 is "low", and diode D5 pulls the base of transistor Q3 low. As the inverting input of the comparator COMP 4 drops below the reference voltage, the output of comparator COMP4 goes "high". The low-to-high state change is coupled back to the non-inverting input via capacitor C7 and resistor R20 to insure a minimum duration of the high state of the output of the comparator COMP4.

The diode D5 is now reverse biased and transistor Q3 is allowed to current amplify the voltage at its base at that moment. Capacitor C6 charges to the new sample value via diode D4 as capacitor C7 is holding comparator COMP4 high. Concurrently, current through the resistor R14 branch is reduced, thus momentarily increasing the frequency of the asymmetrical pulse generator.

Current through resistor R20 falls and a point is reached where the voltage at the non-inverting input drops below the voltage at the inverting input. The high-to-low state change at the output of comparator COMP4 drops the base of transistor Q3 low again to conclude the sample. Diode D4 is connected to serve to block emitter-base reverse breakdown current.

Capacitor C6 now discharges through resistor R21 until the inverting input of comparator COMP4 again is lower than its non-inverting input, and the cycle repeats with a new sample. The cycle period will depend on the amplitude of the last sample taken relative to the reference voltage and the RC time constant of capacitor C6 and resistor R21. It is important to note in this circuit that the minimum voltage is always greater than the reference voltage. If a sample is taken coincident with the asymmetrical pulse state transition, some unpredictable voltage between the minimum voltage and the maximum voltage will be seen at capacitor C6. Further, the probability that the sample will tend towards Vmin or Vmax is largely dictated by the duty cycle of the asymmetrical pulse genertor.

Figure 3:
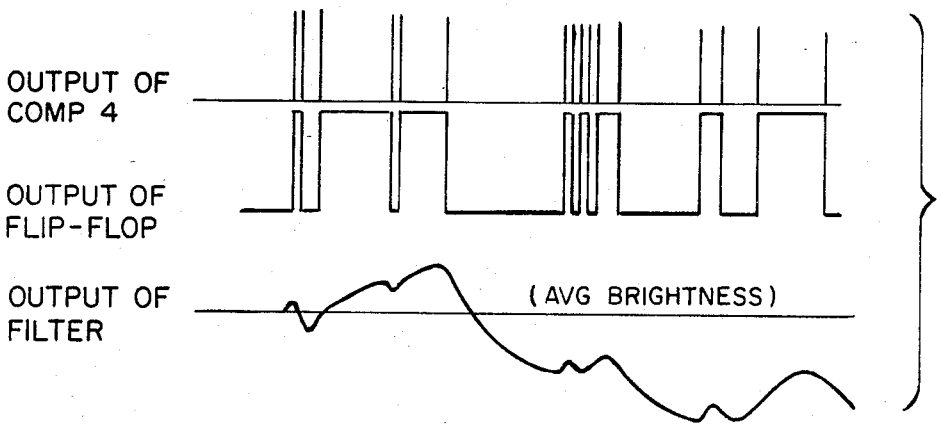
FIG. 3 is a graphical illustration depicting the modulation effect accomplished by the flame simulation apparatus.
Figure 4:
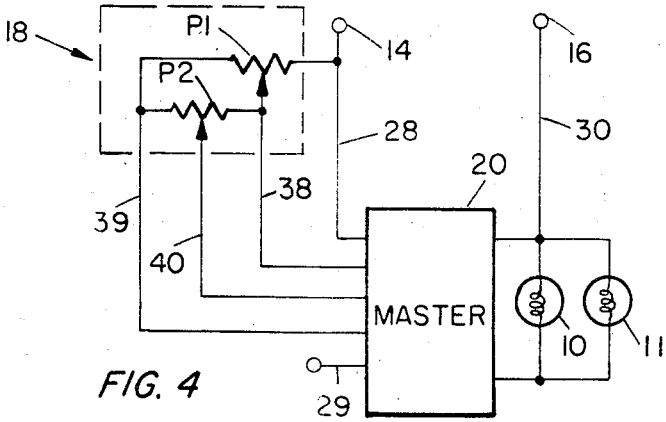
FIG. 4 is a block diagram of the flame simulating apparatus depicting the lamp devices connected in parallel circuit configuration.

With proper selection of component values, the length of time the output of comparator COMP4 is "high" for each new sample will be less than one millisecond, thus effectively resulting in a random time scale oriented series of "spikes" as depicted in the upper graph of FIG. 3, designated "output of COMP4".

This series of spikes will appear on lead 56 which is connected to the emitters of the transistors Q4 and Q5 of the squaring flip-flop, with each successive spike altering the output state of the flip-flop as sensed at the anode of diode D6. This output is depicted in the center graph of FIG. 3, designated "output of flip-flop", and appears as a pulse width modulated output having an amplitude determined by the value of the voltage appearing at resistor R27, this being the "flicker demand voltage.

By adjusting flicker pulse amplitude prior to final filtering, precise voltage-controlled "attenuation" can be achieved with a minimum component count. The diode D6 at the output of the flip-flop will only pass current when the voltage at resistor R27 is brought lower than approximately one volt below V+. The peak-to-peak amplitude seen at capacitor C9 will be equal to the voltage drop across resistor R26 during conduction of diode D6.

Transistor Q6 and the filter components comprise a low-pass filter designed to soften flicker attack and decay characteristics and to generate very low (less than 1 Hz) Dc offset components. This complex very low frequency waveshape is coupled via capacitor C12 to modulate the brightness demand reference voltage appearing at resistor R34, and assists in achieving the "flame" or candlelight effect. This flame effect is graphically depicted in the lower curve of FIG. 3, designated "output of filter". In FIG. 3, the curves are in vertical alignment with the impact of each pulse of the output of the comparator COMP 4 being correlated to the corresponding impact on the output of the flip-flop and correspondingly to the output of the low-pass filter at the input to the inverting input of comparator COMP2. As illustrated in the lower curve of FIG. 3, minute dips and peaks appear on the resultant waveform to thus provide a "flickering" effect. The horizontal line in the lower waveform of FIG. 3 is designated "average brightness" to illustrate that the complex waveform resulting from flicker modulation occurs at an average "brightness" intensity level as selected by varying potentiometer P1.

As has been described, both brightness and flicker intensity circuits are voltage-controlled by design and therefore work well where tracking of module response characteristics in a multiple module system is necessary. The relatively low impedance potentiometers P1 and P2 work well in providing reference voltages with systems of up to five or six slave modules 20–22. The fact that both brightness and flicker intensity are reduced when their respective reference voltages move in the direction of the voltage source V+ makes it possible to easily "link" flicker intensity with brightness control so as to maintain a constant relative flicker irrespective of a new brightness setting.

Again, owing to the voltage-controlled nature of the brightness and flicker intensity circuits, it is desirable to insure that all key reference voltage levels are equal between modules in a multiple module system. This would include ground, V+, flicker demand and brightness demand reference voltages. Additionally, the reference ramp voltage should be the same between modules at any given moment, and this may be provided for by ORing together all ramp generator outputs, thus averaging any differences in time constants.

Referring again to FIG. 1, the apparatus according to the invention provides for the maintaining of proper voltages between modules. With slave modules 21 and 22 having the "zero-cross detector" and ramp generators excluded, lead 29 from the master module 20 essentially ensures that the slave modules 21 and 22 receive the proper time-referenced signal, while leads 38, 39 and 40 from the intensity controller 18 provide identical voltage signals to all modules, thus maintaining the "tracking" of the incandescent lamps 10–12 relative to a common base.

FIG. 3 depicts an alternate circuit arrangement utilizing one master module with two lamp devices 10 and 11 connected in parallel for simultaneous control. The interior components of the intensity controller 18 are shown with the interconnections to the master module 20, with the "reset" lead 29 being unconnected.

Figure 5:
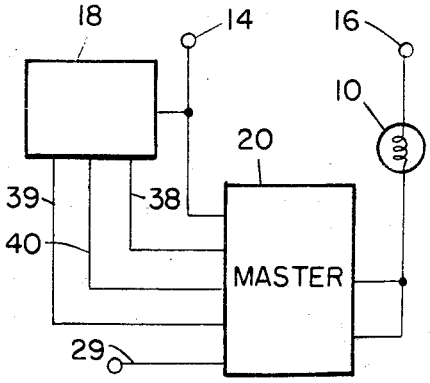
FIG. 5 is a block diagram of the flame simulating apparatus depicting the lamp device connected in series circuit relation.

FIG. 5 depicts another arrangement for a single lamp device 10 connected in series between the output of the master module 20 and the terminal 16 of the alternating current source.

With the modular construction, by reference again to FIG. 1, it is possible to incorporate two master modules 20 in the positions occupied by slave modules 21 and 22, with all three master modules 20–22 being interconnected via lead 29, this effectively being the ORing arrangement previously discussed. In this manner, if any one of the ramp generator outputs goes low, all ramp generators are reset. The ramp voltage can only begin when they are all high in this type of connection.

Figure 6:
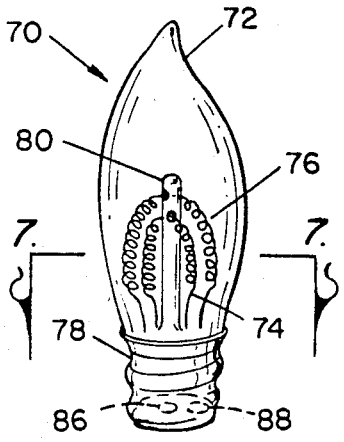
FIG. 6 is a front view of a multiple filament incandescent lamp device according to the invention.
Figure 7:
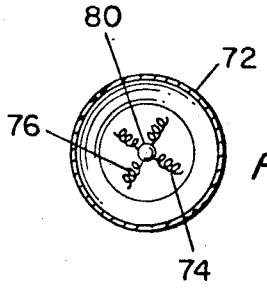
FIG. 7 is a cross-sectional view of the lamp device of FIG. 6 as viewed generally along Line 7—7 thereof.
Figure 8:
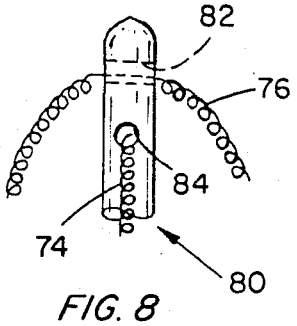
FIG. 8 is an enlarged view of the filament arrangement of the lamp device of FIG. 6.

Referring now to FIGS. 6 through 8, there is shown a lamp device 70 which includes a glass envelope 72 housing first and second incandescent lamp filaments 74 and 76, which have the leads thereof electrically available through the base 78. The lamp device 70 is particularly suited to the flame simulating apparatus according to the invention, and provide the simulation of motion of a flame.

The filaments 74 and 76 are mounted within the envelope 72 at the upper ends thereof by mechanical connection to a suitable supporting post 80. As better illustrated in FIG. 8, the post may be formed of glass or other suitable insulating material, with apertures 82 and 84 formed in the upper end, the apertures extending through the post 80 at right angles to one another to support the filaments at right angles to each other. The apertures 82 and 84 are spaced from one another to electrically isolated the two filaments 74 and 76 from one another within the envelope 72. For reasons which will be discussed, it is preferable that the envelope 72 be constructed of translucent, or frosted glass which diffuses light passing therethrough.

As shown, the filaments 74 and 76 are contoured in the shape of a candle flame, that is each filament has a generally triangular configuration with the apex at the top. The material selected for each filament is different. Preferably one filament 74 will be formed form a conductive material, which on incandescing at normal household voltage will emit a white light, while the filament 76 will be formed from a material which emits a light in the yellow spectrum at incandescence. In this manner, in conjunction with the frosted glass material of envelope 72 which diffuses the light passing therethrough, the overall effect is to simulate candle flame motion in colors approximating those of a candle flame.

In prior art lamps for simulating candles, such as the neon gas type previously described, the two electrodes therein are spaced generally parallel to one another, as a consequence of which the simulated moving flame effect is viewable only when looking directly at the profile of the electrodes. When viewing the gas discharge at right angles thereto, there is no apparent flame movement. With the lamp device 70, with each filament angularly disposed relative to the other, and with each filament 74 and 76 independently energized by appropriate modules 20, a simulation of a moving flame is viewable from all angles.

The base 78 is of conventional configuration, that is cylindrical shell-shaped with an open bottom suitably filled with an insulating material, with the ends of the filaments 74 and 76 having one end thereof electrically connected to the base 78, and the other ends connected electrically to independent terminals 86 and 88, shown in exaggerated view. With such connections, the base material serves as as common connection for the two filaments 74 and 76.

Figure 10:
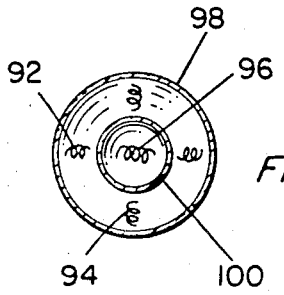
FIG. 10 is a cross-sectional view of the lamp device of FIG. 10 as viewed generally along Line 10—10 thereof.
Figure 9:
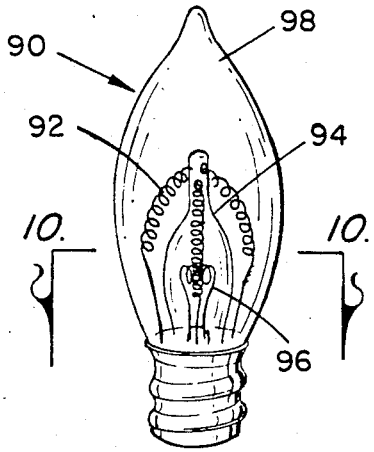
FIG. 9 is a front view of an alternate embodiment of a multiple filament lamp device.

FIGS. 9 and 10 depict an alternate embodiment of a multiple filament lamp 90, in which three filaments 92, 94 and 96 are assembled within the glass envelope 98. Filaments 92 and 94 are assembled in generally identical manner to filaments 74 and 76.

However, filament 96 is much smaller in overall size and is mounted within another smaller envelope 100. The envelope 98 may be a conventional frosted glass, while the envelope 100 is preferably a colored glass, such as a blue-green glass material. With filament 92 emitting a white color at normal household voltage and filament 94 emitting a yellow color at the same voltage, the material for filament 96 may be selected to emit white, with the envelope 100 providing a bluish-green cast, such as normally seen at the core of a flame.

Figure 11:
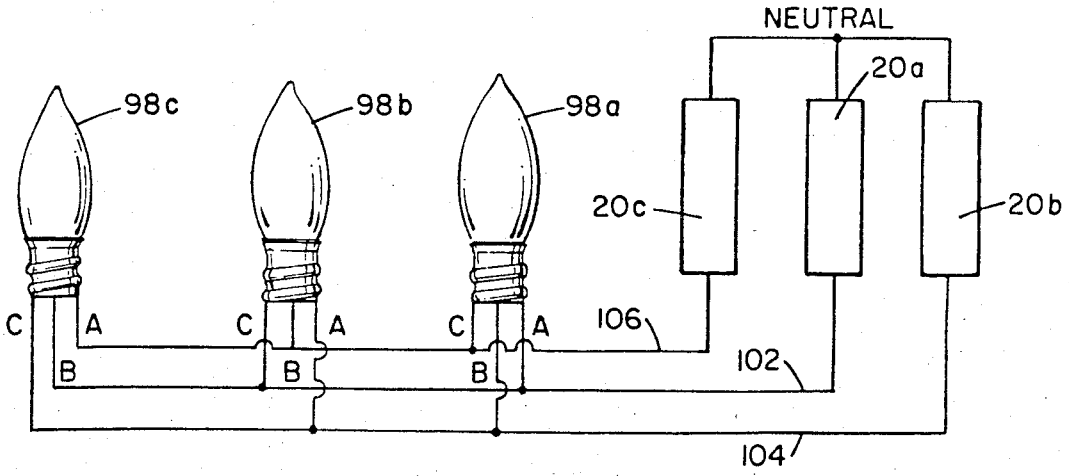
FIG. 11 is a block diagram representation of the electrical connections of separate flame simulation modules to a plurality of the lamp devices of FIG. 9.

FIG. 11 depicts a system utilizing three lamp devices **98*a*–98*c*, with three modules 20*a*–20*c* electrically connected thereto. Each of the three filament connections at the bases of the lamp devices 98*a*–98*c* are designated A, B, or C to represent the electrical connection for filaments 92, 94 and 96, respectively. Module 20*a* has an output lead 102 connected to each of the A filament connections, with modules 20*b* and 20*c***, respectively interconnecting the B and C filaments. With this arrangement, each of the filaments is independently energized to provide pseudo-random flickering and thus create a simulation of a flame, both in color, and in movement.

In accordance with the present invention, there has been shown and described a flame simulating apparatus which provides for "standard dimmer" operation (no flicker modulation) in conjunction with user-adjustable flicker or flame-simulation intensity. In addition, there has been shown a system for providing master control of several independently acting flame simulation modules (master or slave modules). In contrast prior art devices have provided either preset non-adjustable intensity, or alternatively impedance-controlled intensity through variable resistances without the capability of operating as a conventional dimmer system. In addition there has been shown and described a novel lamp device particularly suited for use with the electrical circuitry herein.

While there has been shown and described a flame simulating apparatus in accordance with the illustrated embodiment, it is to be understood that various other adaptations and modifications may be made within the spirit and scope of the invention. By way of example, the potentiometers P1 and P2 are depicted as one means of providing variable DC control signals, and other variable voltage means may be used. In addition, the random generation of a pulse-width modulated amplitude controlled waveform may likewise be effected in a manner other than that used in the drawings. Many of the functions can likewise be accomplished digitally, rather than in the analog shown, and the invention is to be limted only to the scope of the claims included herein.

I claim:

1. In an apparatus for connection to an alternating current power source to simulate a flame emission, the combination comprising:

at least one electrical lamp device;

a controllable switching device in series relation with said at least one lamp device, said switching device being controllable into conduction through a given phase angle of an alternating current pulse;

means for gating said switching device;

comparator means for controlling said gating means;

a first input means to said comparator means, said first input means providing a time-proportional signal synchronized to begin at the approximate time of passage of the source voltage waveform through zero;

a second input means to said comparator, said second input means providing a generally random pulse-width modulated amplitude controlled input;

first variable signal control means coupled to the power source and in circuit relation with second input means for providing a first control signal for controlling the average intensity of said input; and second variable signal control means coupled to receive said first control signal and in circuit relation with said second input means for providing a second control signal for controlling the amplitude of said input of said second input gating means to control said switching device into conduction through the so-selected phase angle to control energy from the power source to said lamp device to simulate a flame or to function as a light dimming control system.

2. The combination according to claim 1 wherein said first input means includes a signal generator means responsive to the zero-crossing of the source voltage.

3. The combination according to claim 2 wherein said first input means includes means for initiating the start of a time-proportional signal in response to the zero-crossing of the power source.

4. The combination according to claim 1 wherein said second input means includes asymmetrical signal generating means.

5. The combination according to claim 4 wherein said second input means includes means for sampling the output of said asymmetrical signal generating means.

6. The combination according to claim 5 wherein said second input means includes flip-flop means responsive to the output of said sampling means for generating a time-state modulated signal.

7. The combination according to claim 6 wherein said apparatus includes processing means for modifying the time-magnitude relationship of said time-state modulated signal.

8. In an apparatus for connection between a source of alternating current power and an electric lamp device for providing energy to the lamp to simulate a flame, the combination comprising:

means for rectifying the power source;

first adjustable signal control means coupled to said rectifying means for providing a first control signal representative of the desired lamp intensity;

second adjustable signal control means coupled to said first control signal for providing a second control signal representative of the desired flicker intensity;

controllable switching means in circuit relation with said lamp; and other means coupled to the power source and coupled for receiving said first and second control signals for generally randomly actuating said controllable switching means first for controlling the amount of power to the lamp device to provide an average brightness of the lamp device in accordance with the magnitude of said first control signal, and second for generally randomly modulating the controlled power provided to said lamp device to provide a flicker intensity about the average brightness of the lamp device in accordance with the magnitude of said second control signal.

9. The combination according to claim 8 wherein said first and second signal control means are manually adjustable.

10. The combination according to claim 9 wherein said other means includes means for providing a modulated signal in response to the values of said first and second control signals.

11. The combination according to claim 8 wherein said other means includes means for generating a complex signal, the characteristics of which are determined, at least in part, by said first and second control signals, for selectively actuating said controllable switching means to control the energy to said lamp in general accordance with said complex signal.

12. In an apparatus for connection between a source of alternating current power and an electric lamp device for providing energy to the lamp to simulate a flame, the combination comprising:

means for rectifying the power source;

first adjustable signal control means coupled to said rectifying means for providing a first control signal representative of the desired lamp intensity;

second adjustable signal control means coupled to said first control signal for providing a second control signal representative of the desired flicker intensity;

controllable switching means in circuit relation with said lamp; and other means coupled to the power source and coupled for receiving said first and second control signals for generally randomly actuating said controllable switching means first to provide an average brightness of the lamp in accordance with the magnitude of said first control signal, and second to provide a flicker intensity about the average brightness of the lamp in accordance with the magnitude of said second control signal, said other means including asymmetrical signal generating means for generating a complex signal and means for sampling the output thereof, the characteristics of said complex signal being determined, at least in part, by said first and second control signals, for selectively actuating said controllable switching means to control the energy to said lamp in accordance with said complex signal.

13. The combination according to claim 12 wherein said other means includes means responsive to said sampling means for generating a time-state modulated signal.

14. The combination according to claim 13 wherein said other means includes means for processing said time-state modulated signal.

15. The combination according to claim 14 wherein said first control signal provides a signal for controlling the average brightness of the lamp, and said second control signal controls the extent of magnitude change of said signal about the value of said first control signal.

16. The combination according to claim 12 wherein said controllable switching means includes a switching device controllable into conduction through a selectable portion of the phase angle of an alternating current pulse.

17. The combination according to claim 16 wherein said other means includes means for detecting the phase angle of said alternating current source and means for gating said switching device into conduction, said gating means being responsive, at least in part, to said detecting means.

18. In a system for connection between an alternating current power source and a plurality of electrical lamp devices for controlling said lamp devices to simulate a flame, the combination comprising:

a controller module having first manually adjustable means for providing a first control signal for controlling the average brightness of said at least one lamp device, and second manually adjustable means for receiving said first control signal and for providing a second control signal; and a first other module in circuit relation with said controller module, one of said lamp devices and the alternating current power source, said first other module including means for rectifying the alternating current source and for providing the so-rectified voltage to said first manually adjustable means of said control module, controllable switching means adapted for connection to said one of said lamp devices, and other means for coupling to the power source and for receiving said first and second control signals for generally randomly actuating said controllable switching means first for controlling the amount of power to the said one of said lamp devices to provide an average brightness of the said one of said lamp devices in accordance with said first control signal, and second for generally randomly modulating the controlled power provided to the one of said lamp devices to provide a variable intensity about the average brightness of the said one of said lamp devices in accordance with said second control signal for controlling the energy to the said one of said lamp devices to simulate a flame emission or to function as a light dimming control system; and a second of said other modules connected to a second of said lamp devices and said controller module for controlling the average intensity and flicker intensity of said second lamp device in uniform accordance with the average intensity and flicker intensity of said first lamp device while enabling independent random modulation of the flicker of each of said lamp devices.

19. The combination according to claim 18 wherein said controller module includes means for coupling to said alternating current power source for providing a time-referenced control signal initiated generally at the zero-crossing of the power source waveform, and each of said other modules is in synchronization with said time-referenced control signal.

20. In a system for emitting light energy simulating a flame, the combination comprising:

at least one electrical lamp device;

a power source;

first adjustable means connected to said power source for generating a first control signal;

second adjustable means connected to said first control signal for generating a second control signal; and other means coupled between said power source and said at least one incandescent lamp device for selectively controlling the energy from said power source to said lamp device to control the average brightness of said lamp device in proportion to said first control signal and to intermittently fluctuate the brightness of said lamp device about the level of said average intensity in response to said second control signal, whereby the emission of light energy from said at least one lamp device simulates a flame.

21. The combination according to claim 20 wherein said other means includes means for generally randomly generating a fluctuating magnitude signal about the value of said first control signal in response to the value of said first and second control signals.

22. The combination according to claim 21 wherein said other means includes controllable switching means in circuit relation with said at least one lamp device and said switching means is controlled into conduction, at least in part, by said fluctuating magnitude signal.

23. In a system for simulating a flame emission, the combination comprising:

a multiple filament lamp device having at least two independently energizable filaments; and circuit means including connections to each of said filaments and being capable of providing generally random energy to each filament whereby energization of said filaments from a power source through said circuit means simulates the motion of a candle flame, said circuit means including first adjustable signal control means coupled for providing a first control signal respresentative of the desired lamp intensity to all of said filaments;

second adjustable signal control means coupled to said first control signal for providing a second control signal representative of the desired flicker intensity to all of said filaments;

a two input control means for each of said filaments, each of said two input control means having an output;

a controllable switching means in circuit relation with each filament of said lamp device, each of said controllable switching means being coupled to the output of said two input control means;

other means coupled for receiving said first control signal for providing a time-proportional first input to each of said two input control means for controlling the output thereof for providing energy to each said controllable switching device for controlling uniformly the average intensity of each filament of said lamp device; and random signal generating means for each of said filaments responsive to said second control signal for providing a generally randomly modulated signal to the second input of each of said two input control means for modulating the output thereof for providing a flicker intensity in each said filament of said lamp device about the average intensity thereof in accordance with the magnitude of said second control signal.

24. The combination according to claim 23 wherein said device further includes a third independently energizable filament.

25. The combination according to claim 24 wherein said third filament is smaller in size than said first and second filaments and said device further includes a second at least partially transparent envelope internediate said third filament and said first and second filaments.

26. The combination according to claim 25 wherein said second envelope is formed of a generally bluish glass substance.

27. The combination according to claim 23 wherein one of said at least two filaments emits light of a first color upon energization, and enother of said at least two filaments emits light of a second color upon energization.

28. The combination according to claim 27 wherein said first and second colors are yellow and white, respectively.

29. The combination according to claim 23 wherein said lamp device includes three filaments and means are provided for emitting light of three different colors upon energization of said filaments.

30. The combination according to claim 29 wherein the three colors are generally white, generally yellow and generally blue.

31. The combination according to claim 30 wherein said means for providing different colors includes, at least in part, a colored glass envelope about at least one of said filaments.

32. The combination according to claim 23 wherein said at least two filaments are angularly disposed relative to one another and configured in the shape of a candle flame.

33. In an apparatus for connection between a source of alternating current power and an electric lamp device for providing energy to the lamp to simulate a flame, the combination comprising:

means for rectifying the power source;

first adjustable signal control means coupled to said rectifying means for providing a first control signal representative of the desired lamp intensity;

second adjustable signal control means coupled to said first control signal for providing a second control signal representative of the desired flicker intensity;

two input control means having an output;

controllable switching means in circuit relation with said lamp, said controllable switching means being coupled to the output of said two input control means;

other means coupled for receiving said first control signal for providing a time-proportional first input to said two input control means for controlling the output thereof for providing energy to said controllable switching device for controlling the average intensity of said lamp device; and random signal generating means responsive to said second control signal for providing a generally randomly modulated signal to the second input of said two input control means for modulating the output thereof for providing a flicker intensity in said lamp device about the average intensity of said lamp device in accordance with the magnitude of said second control signal.

* * * * *